United States Patent [19]

Imaseki et al.

[11] Patent Number: 4,911,566

[45] Date of Patent: Mar. 27, 1990

[54] BRAKING CONTROL SYSTEM FOR THERMAL PRINTHEAD

[75] Inventors: Chiharu Imaseki; Takeshi Kato, both of Osaka, Japan

[73] Assignee: Minolta Camera Kabushiki Kaisha, Osaka, Japan

[21] Appl. No.: 203,153

[22] Filed: Jun. 6, 1988

[30] Foreign Application Priority Data

Jun. 5, 1987 [JP] Japan ..... 62-141800

[51] Int. Cl.[4] ..... B41J 3/20

[52] U.S. Cl. ..... 400/120; 346/76 PH; 318/315

[58] Field of Search ..... 400/320, 120, 59; 318/375; 346/76 PM

[56] References Cited

U.S. PATENT DOCUMENTS

| | | | |
|---|---|---|---|
| 3,882,988 | 5/1975 | Sloan | 400/320 |
| 4,349,770 | 9/1982 | Ragen | 400/320 |
| 4,420,716 | 12/1983 | Imazeki | 318/375 |
| 4,423,363 | 12/1983 | Clark | 318/375 |
| 4,505,603 | 3/1985 | Yana | 400/120 |
| 4,562,444 | 12/1985 | Nagashima et al. | 346/76 PH |
| 4,614,949 | 9/1986 | Hakkaku et al. | 346/76 PH |
| 4,625,218 | 11/1986 | Watanabe | 346/76 PH |
| 4,629,949 | 12/1986 | Senso | 318/374 |
| 4,642,656 | 2/1987 | Shibuya et al. | 346/76 PH |
| 4,812,059 | 3/1989 | Masaki | 400/59 |

FOREIGN PATENT DOCUMENTS

| | | | |
|---|---|---|---|
| 58-140272 | 8/1983 | Japan . | |
| 60-73878 | 4/1985 | Japan . | |
| 60-89375 | 5/1985 | Japan . | |
| 94371 | 10/1985 | Japan | 400/120 |
| 61-130076 | 6/1986 | Japan . | |
| 61-246070 | 11/1986 | Japan . | |

*Primary Examiner*—David A. Wiecking
*Assistant Examiner*—Steven S. Kelley
*Attorney, Agent, or Firm*—Wenderoth, Lind & Ponack

[57] ABSTRACT

A thermal printer in which a thermal head block is moved into and out of pressure contact with a platen roller through a cam mechanism which is driven by a controlled DC motor. The DC motor alternately effects dynamic braking and negative-phase braking before the thermal head is pressed upon the platen roller.

2 Claims, 9 Drawing Sheets

Fig. 3 (1)
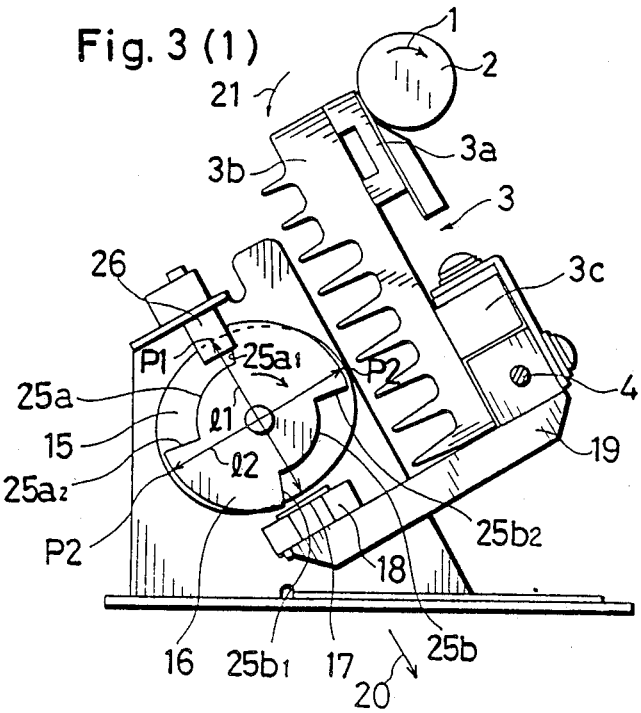
Fig. 3(2)
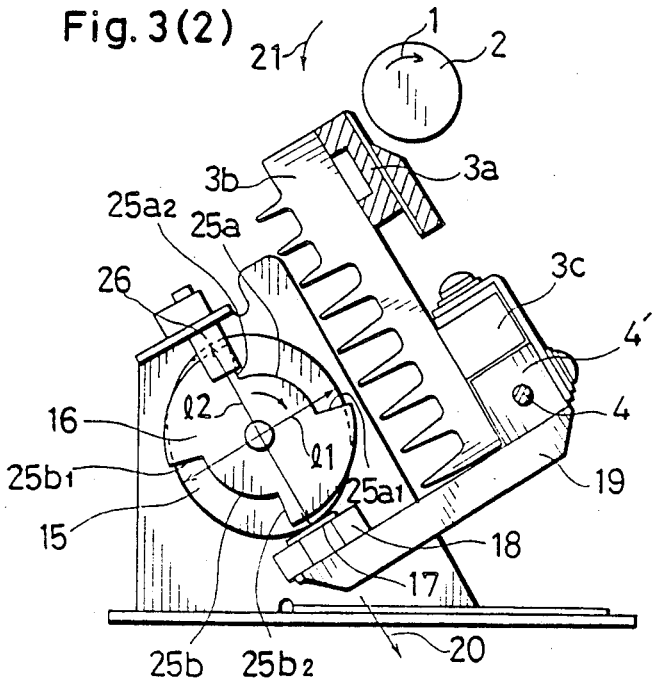

Fig. 6 (1)
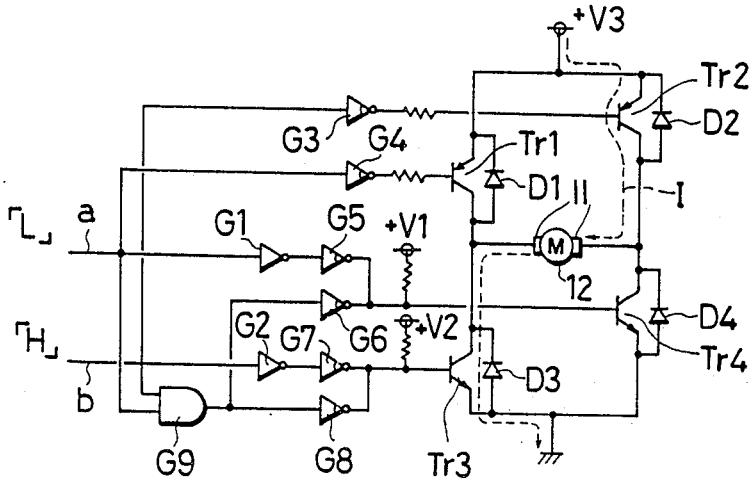
Fig. 6 (2)
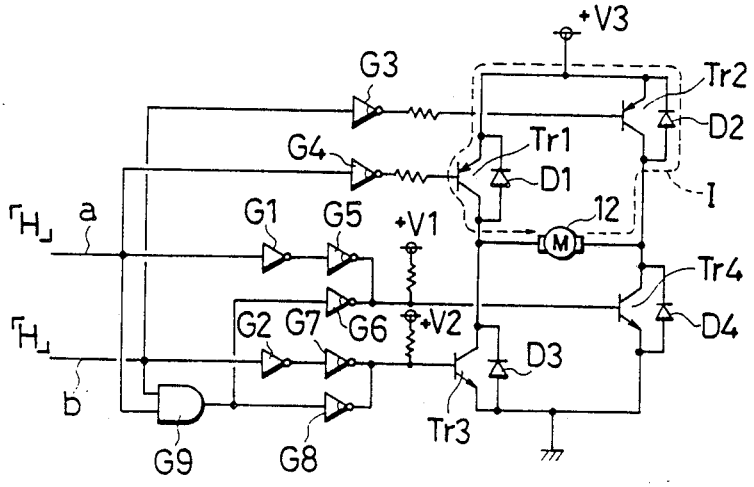

Fig. 6 (3)
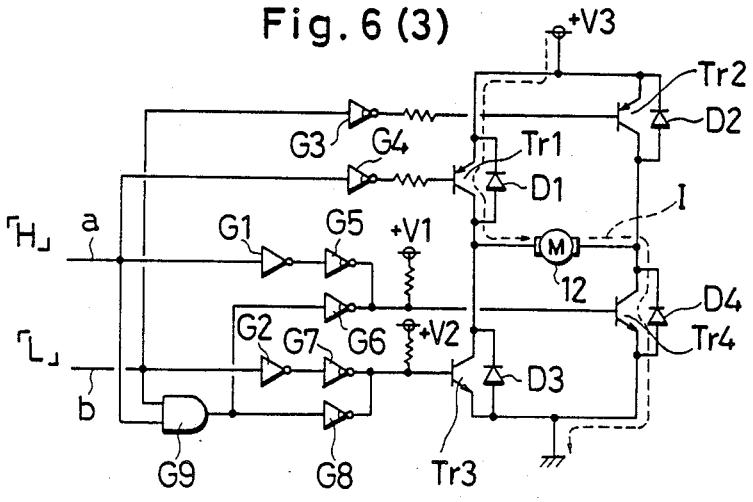

BRAKING CONTROL SYSTEM FOR THERMAL PRINTHEAD

BACKGROUND OF THE INVENTION

1. Field of the Invention

The present invention relates to thermal printers, and more particularly a thermal printer for carrying out a printing operation with a thermal head pressed upon a platen roller.

2. Description of the Prior Art

In this type of thermal printer, the thermal head is placed in pressure contact with recording paper on the platen roller with an ink ribbon disposed therebetween for carrying out a printing operation. The thermal head is moved away from the platen roller when not printing to allow the ink ribbon to be fed and the recording paper to be returned.

A typical example of the mechanism for moving the thermal head into and out of pressure contact is disclosed in Japanese Patent Publication Kokai No. 60-73878. This prior art mechanism includes a spring for urging the thermal head away from the platen roller, and a solenoid for driving the thermal head into pressure contact with the platen roller against the force of the spring. During printing the solenoid is activated to press the thermal head upon the platen roller against the force of the spring. When not printing, the solenoid is de-activated to allow the thermal head to be separated from the platen roller under the force of the spring. According to this prior art, the solenoid must be activated throughout a printing operation, which involves a wasteful consumption of power. Furthermore, since the solenoid is used, impulsive sounds are produced when the solenoid turns on and off. This is a serious drawback because low noise is a desired feature of thermal printers.

A construction intended for solving this problem has been disclosed in Japanese Patent Publication Kokai No. 61-130076. This known construction comprises a stepper motor and an asymmetrical cam driven by the motor. The cam is stopped at selected positions under control by the stepper motor to move a thermal head into and out of pressure contact with a platen roller.

Although this construction does not produce impulsive sounds since a solenoid is not employed, the use of the stepper motor results in a high manufacturing cost.

SUMMARY OF THE INVENTION

The object of the present invention, therefore, is to solve the technical problem as noted above and provide a thermal printer which does not produce noise when moving the thermal head into and out of pressure contact with the platen roller, and which is inexpensive to manufacture.

This object is fulfilled, according to the present invention, by a thermal printer comprising a rotatable platen roller, a thermal head opposed to the platen roller and movable into and out of pressure contact therewith, pressing and separating means for movably retaining the thermal head in a contact position for pressing upon the platen roller and a separated position away from the platen roller, a DC motor for driving the pressing and separating means, first braking means for braking the DC motor by causing a short-circuit between feeder terminals of the DC motor, second braking means for braking the DC motor by applying a voltage of reversed polarity to the feeder terminals of the DC motor, and control means for stopping the thermal head at the contact position by alternately operating the first braking means and the second braking means immediately before the thermal head reaches the contact position.

The thermal printer may further comprise detecting means for detecting the position of the thermal head. In this case, the control means operates the first braking means and the second braking means in response to the detecting means.

The control means may stop the thermal head at the separated position by operating the first braking means immediately before the thermal head reaches the separated position.

In a further aspect of the invention, there is provided a braking device used in a moving apparatus for moving an object from a first position to a second position, and having a DC motor as a drive source. This braking device comprises detecting means for detecting arrival of the object at a third position intermediate the first position and the second position, first braking means for braking the DC motor by causing a short-circuit between feeder terminals of the DC motor, second braking means for braking the DC motor by applying a voltage of reversed polarity to the feeder terminals of the DC motor, and control means responsive to the detecting means for stopping the object at the second position by alternately operating the first braking means and the second braking means.

In the thermal printer according to the present invention, the DC motor is turned on to drive a cam included in the pressing and separating means when separating the thermal head from the platen roller. When the detecting means detects arrival of the cam at a first detecting position, dynamic braking is applied to the DC motor. As a result, the cam is stopped at a first stopping position. In this state the cam holds the thermal head at the position away from the platen roller against the force of urging means.

When pressing the thermal head upon the platen roller, the DC motor is turned on to drive the cam. When the detecting means detects arrival of the cam at a second detecting position, the dynamic braking and negative-phase braking are alternately applied to the DC motor. As a result, the cam is stopped precisely at a second stopping position. In this state, the cam imparts no force to the thermal head and the force of the urging means maintains the thermal head in pressure contact with the platen roller.

Thus, the thermal head is driven by the DC motor to and from the platen roller without any noise.

BRIEF DESCRIPTION OF THE DRAWINGS

These and other objects or features of the present invention will become apparent from the following description of a preferred embodiment thereof taken in conjunction with the accompanying drawings, in which:

FIG. 3 (1) is a view showing the thermal head and a platen roller in pressure contact with each other, FIG. 3 (2) is a view showing the thermal head and the platen roller separated from each other.

DETAILED DESCRIPTION OF THE INVENTION

Figure 11:
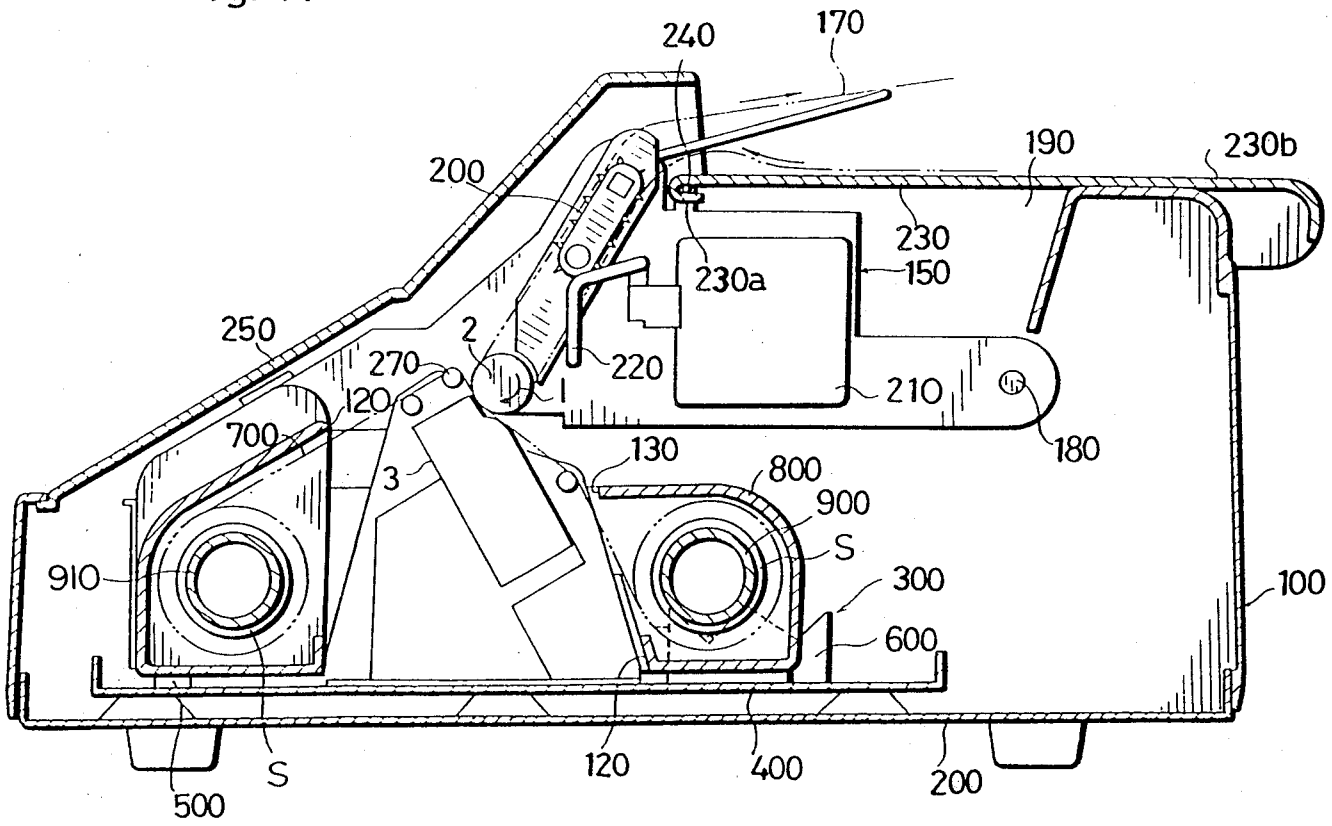
FIG. 11 is a sectional view showing the interior construction of a thermal printer embodying the present invention.

Referring to FIG. 11, a thermal printer according to the present invention comprises a casing 100 including a bottom plate 200 carrying a cassette mount 300. The cassette mount 300 includes a base 400, a polyurethane form 500 and a rear position setting block 600 for removably holding an ink ribbon cassette 800 containing an ink ribbon 700.

The ink ribbon cassette 800 is formed of a plastic material and supports a supply roll 900 and a takeup roll 910 with play S in rear and front positions thereof, respectively. The ink ribbon 700 is wound around the supply roll 900, and has a leading end thereof connected to the takeup roll 910 by an adhesive tape not shown. Thus, the ink ribbon 700 is used for thermal transfer at a position between the two rolls 900 and 910. To allow the thermal transfer, the ink ribbon cassette 800 has a bottom plate and a top plate defining windows 120 and 130, respectively. A thermal head block 3 extends through the windows 120 and 130 of the bottom and top plates of the ink ribbon cassette 800 mounted between the polyurethane form and the block 600 on the base 400 of the cassette mount 300.

The thermal head block 3 pushes up the ink ribbon 700 in the cassette 800 at the position between the two rolls 900 and 910, and presses the ink ribbon 700 upon a platen roller 2 of a paper feeder 150 provided in an upper position of the casing 100. At the position of pressure contact, the thermal head block 3 effects the thermal transfer from the ink ribbon 700 to recording paper 170. After the thermal transfer, the recording paper 170 is advanced in tight contact with the ink ribbon 700 to a separating roller 270 where the ink ribbon 700 and the recording paper 170 are separated from each other. Detail of the thermal head block 3 is described hereinafter with reference to FIGS. 1–3.

The paper feeder 150 is pivotable on a rear hinge pin 180 between an operative position as shown in FIG. 11 and a retracted position upwardly away from the cassette mount 300 (not shown). The casing 150 defines a top opening 190 to avoid interference with the upward pivotal movement of the paper feeder 150. The paper feeder 150 in the retracted position allows easy access to the inside of the printer for attaching and detaching the ink ribbon cassette 800. The paper feeder 150 includes tractor feeders 200 above the platen roller 2, which are driven synchronously with the platen roller 2 to feed the recording paper 170 to the platen roller 2 and advance it away from the platen roller 2 as shown by arrows in FIG. 11. Numeral 210 indicates a drive motor in the paper feeder 150, and numeral 220 indicates a paper position sensor. A paper guide plate 230 is mounted on the paper feeder 150. The guide plate 230 has a bent front end 230*a* removably hooked on a pin 240 of the paper feeder 150, and a rear portion 230*b* just resting on a top rear position of the casing 100. The guide plate 230 is pivotable on the pin 240 to follow the pivotal movement of the paper feeder 150, and is also detachable. The platen roller 2 is rotatable in the direction of arrow 1.

A removable front cover 250 is mounted on the casing 100 forward of the paper feeder 150. The cassette mount 300 is entirely exposed by removing the front cover 250 and swinging the paper feeder 150 to the retracted position, to allow the ink ribbon cassette 800 to be attached and detached with ease.

Figure 1:
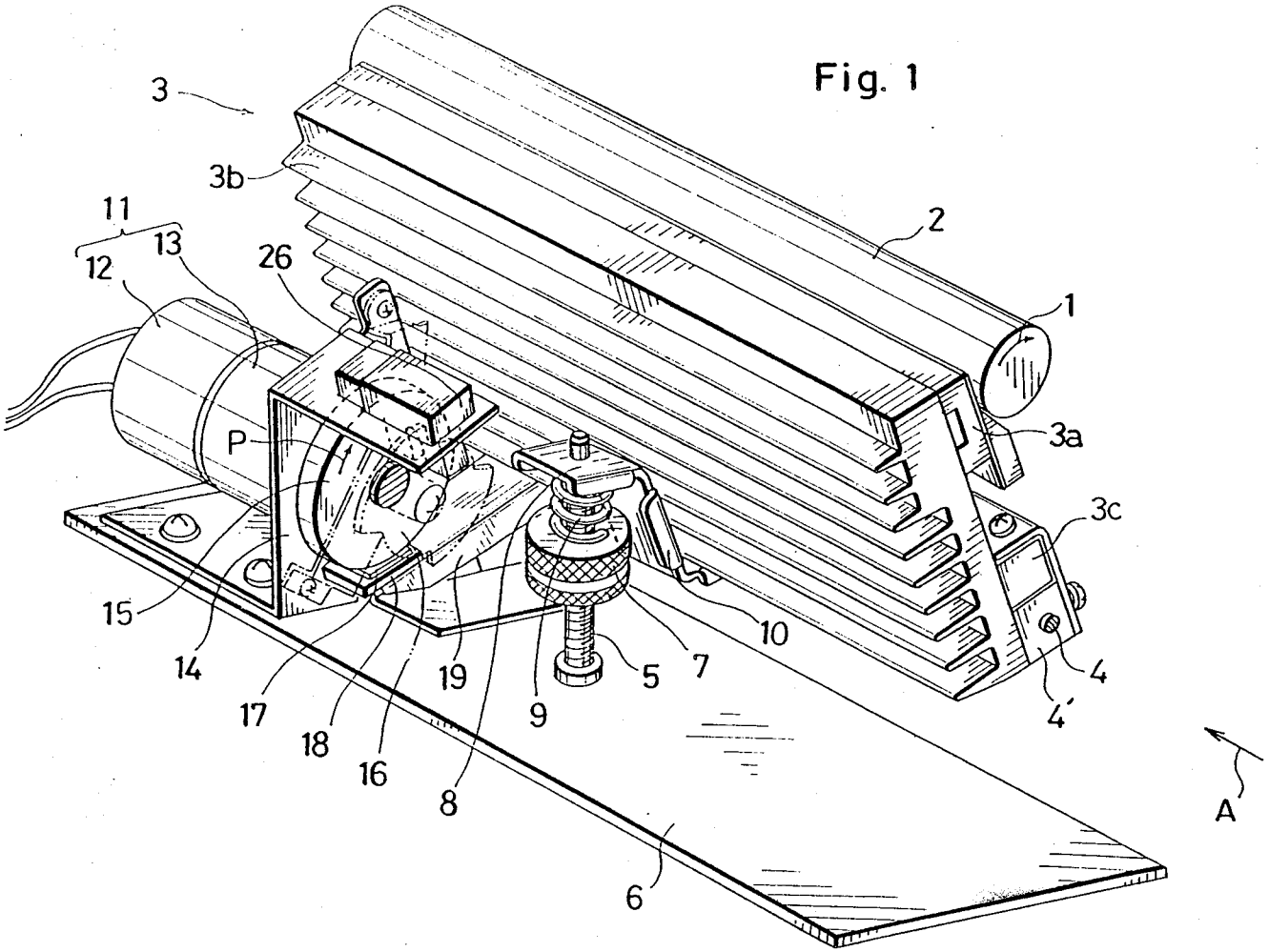
FIG. 1 is a perspective view of a thermal head block.
Figure 2:
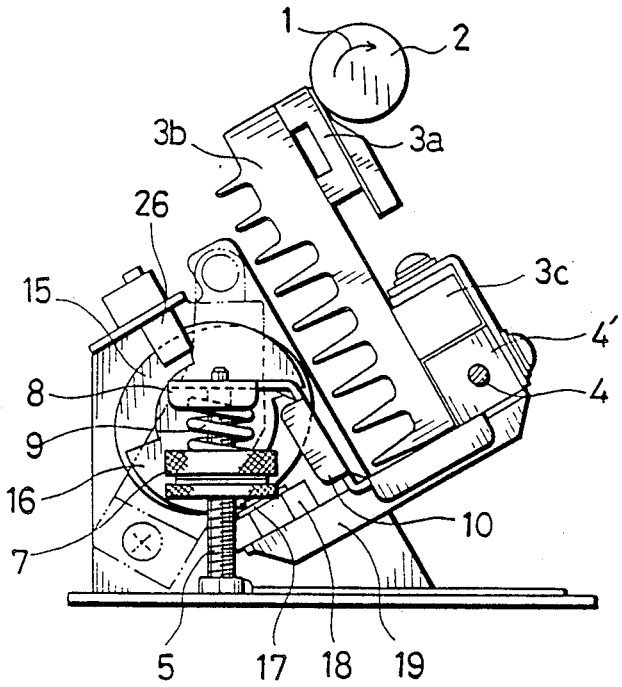
FIG. 2 is a side view seen in the direction of arrow A in FIG. 1.

Referring to FIGS. 1 and 2, the thermal head block 3 includes a thermal head 3*a* having a plurality of heating elements extending linearly and longitudinally of the thermal head 3*a*, a radiator panel 3*b* for diffusing the heat accumulated in the thermal head 3*a*, and an attachment portion 3*c* for connection to a printer frame. The thermal head block 3 is attached at the attachment portion 3*c* to a square bar 4' rotatable on a pivotal axis 4 extending parallel to the platen roller 2. Thus, the thermal head block 3 is pivotable on the axis 4. A support shaft 5 is erected on the bottom 6 of the printer frame in front (the lefthand side in FIG. 2) of the thermal head block 3. The support shaft 5 carries a bolt 7 screwed thereon, a spring shoe 8 disposed above the bolt 7 to be slidable axially of the support shaft 5, and a coil spring 9 acting as a resilient member mounted between the bolt 7 and the spring shoe 8. Thus, the spring shoe 8 is upwardly spring-loaded. The spring shoe 8 is rigidly connected to one end of a lever 10, the other end of the lever 10 being fixed to the square bar 4' rotatable on the pivotal axis 4. Consequently, the thermal head block 3 is urged by the coil spring 9, through the lever 10, into pressure contact with the platen roller 2.

In front (the lefthand side in FIG. 2) of the thermal head block 3 is a DC geared motor (hereinafter referred to just as a DC motor) 11 including a DC motor portion 12 and a gear head portion 13. The gear head portion 13 has an output shaft extending through a mounting plate 14. An elliptical cam wheel 15 and a detection wheel 16 are coaxially fixed to the portion of the output shaft projecting from the mounting plate 14. The cam wheel 15 is contactable at its peripheral surface by a friction plate 17 disposed under the cam wheel 15. This friction plate 17 is fixed to a base 18 which in turn is fixed to one end of a support member 19. The other end of support member 19 is fixed to the square bar 4'.

When the DC motor 11 is driven for moving the thermal head 3*a* into pressure contact with the platen roller 2 as will be described later, the cam wheel 15 and detection wheel 16 rotate in the direction of arrow P. The cam wheel 15 and detection wheel 16 stop at a first stopping position where, as shown in FIG. 3 (1), minimum diameter l1 is substantially at a right angle to the friction plate 17. In this position the peripheral surface of cam wheel 15 is spaced from the friction plate 17.

Consequently, the thermal head 3*a* is pressed against the platen roller 2 by the force of spring 9. A printing operation takes place in this state, and the heating elements of the thermal head 3*a* are selectively driven to carry out printing as desired. To release the thermal head 3*a* from pressure contact, the cam wheel 15 and detection wheel 16 are rotated to diminish the space between the cam wheel 15 and the friction plate 17, with the peripheral surface of cam wheel 15 coming into contact with the friction plate 17 when the angular displacement of cam wheel 15 reaches a predetermined amount, and eventually presses the friction plate 17 in the direction of arrow 20. As a result, the thermal head 3*a* is angularly displaced about the axis 4 against the force of spring 9 in the direction of arrow 21 away from the platen roller 2. The cam wheel 15 rotates further and stops at a second stopping position where, as shown in FIG. 3 (2), the maximum diameter l2 is substantially at a right angle to the friction plate 17. In this position the thermal head 3*a* is its t a maximum distance from the platen roller 2.

The detection wheel 16 defines two peripheral cutouts 25*a* and 25*b* spaced apart from each other in the circumferential direction. A photosensor 26, such as of the photo-interrupt type, is provided so as to straddle the peripheral edge of detection wheel 16. The photosensor 26 includes a light emitter opposed to one side surface of detection wheel 16 and a light receiver opposed to the other side surface thereof.

The photosensor 26 detects changes from transmission to interruption of the light emitted by the light emitter and vice versa, and begins to drive the DC motor 11 when these changes take place. The detection wheel 16 and cam wheel 15 are fixed in such position relative to each other such that one edges $25a_1$ or $25b_1$ of each of the cutouts 25*a* or 25*b* is displaced from a peripheral point P1 at the minimum diameter of cam wheel 15 by a braking distance of the DC motor 11, with the other edge $25a_2$ or $25b_2$ of each of the cutouts 25*a* or 25*b* displaced from a peripheral points P2 at the maximum diameter of cam wheel 15 by the same braking distance.

Accordingly, the cam wheel 15 stops at the first stopping position after rotating through the braking distance from a first detecting position at which one of the edges $25a_1$ or $25b_1$ of the cutout 25*a* or 25*b* passes through the photosensor 26.

Further, the cam wheel 15 stops at the second stopping position after rotating through the braking distance from a second detecting position at which the other edge $25a_2$ or $25b_2$ of the cutout 25*a* or 25*b* passes through the photosensor 26. Thus, the thermal head 3*a* is alternately moved into and out of pressure contact with 90 degree rotations of the cam wheel 15.

Figure 4:
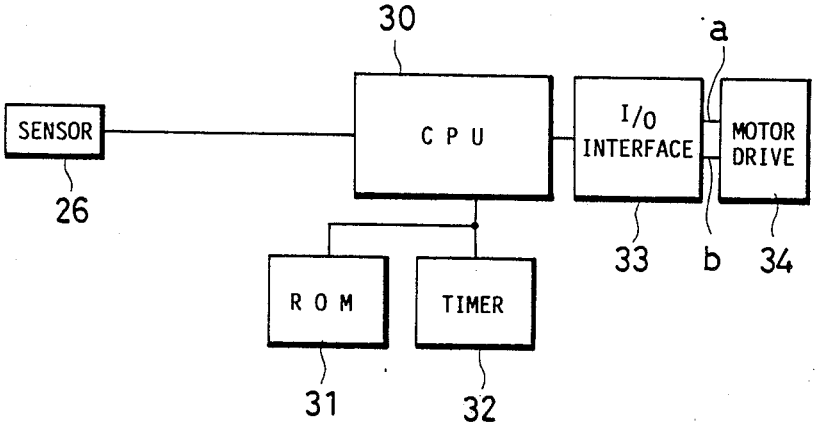
FIG. 4 is a block diagram of an electric system relating to the movement of the thermal head into and out of the pressure contact.

FIG. 4 is a block diagram of an electric system relating to the movement of the thermal head 3*a* into and out of pressure contact. This system includes CPU 30 to which the photosensor 26 applies detection signals. The CPU 30 is connected to a ROM 31 storing a system program and a timer 32. The CPU 30 is also connected, through an I/O interface 33, to a motor drive circuit 34 for driving the DC motor 11. The DC motor 11 is driven in normal rotation and inertial rotation, and is stopped by dynamic braking and negative-phase braking.

Figure 5:
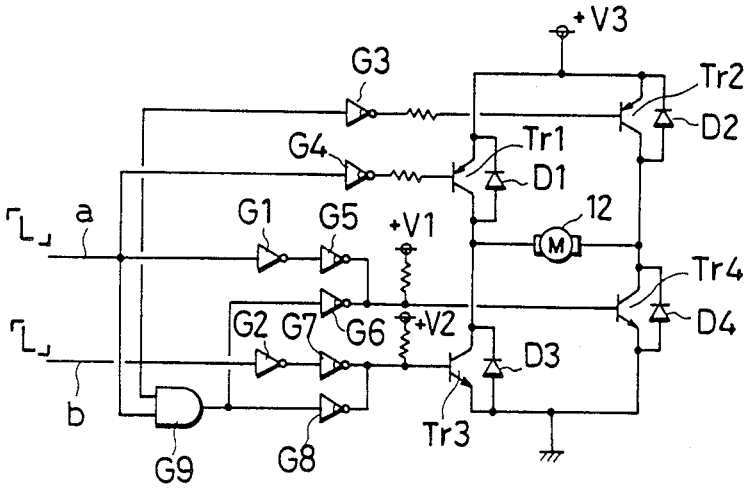
FIG. 5 is a diagram of a motor drive circuit, FIGS. 6 (1) through 6 (3) are views showing directions of current flowing to a DC motor at times of normal rotation, dynamic braking and negative-phase braking.

The motor drive circuit 34 has a construction as specifically shown in FIG. 5. As seen, the circuit 34 includes inverters G1–G8 among which the inverters G3–G8 are of the open collector type. Reference G9 indicates an AND gate. References Tr1 and Tr2 indicate p-n-p transistors, and references Tr3 and Tr4 indicate n-p-n transistors. References D1–D4 indicates diodes in parallel connection between the emitter and the collector of transistors Tr1–Tr4, respectively.

Referring to FIG. 6 (1), when providing a normal rotation mode, CPU 30 plates an output line a in low level and an output line b in high level. As a result, the inverter G3 gives a low level output to render the transistor Tr4 conductive. On the other hand, the inverter G4 gives a high level output to render the transistor Tr1 nonconductive. The inverter G6 gives a high level output. At this time, since the inverter G5 is open collector type, an induction current flows from a source +V1 to the output terminal of inverter G5 whereby the base of transistor Tr4 becomes low level. Consequently, the transistor Tr4 becomes nonconductive. The inverter G7 gives a high level output and the inverter G8 a high level output, to induce no current from a source +V2. As a result, the transistor Tr3 becomes conductive. Thus, during the normal rotation mode, transistors Tr1 and Tr4 are nonconductive and transistors Tr2 and Tr3 conductive. At this time a current I flows from a source +V3 as shown in a dotted line in FIG. 6 (1), through the feeder terminals 11 of motor 12 to drive the DC motor 12 in normal rotation.

When providing an inertial rotation mode, CPU 30 places both the output lines a and b in low level. As a result, inverters G3–G8 give high level outputs. All of the transistors Tr1–Tr4, therefore, become nonconductive to apply no voltage to the DC motor 11.

Referring to FIG. 6 (2), when providing a dynamic braking mode, CPU 30 places both of the output lines a and b in high level. As a result, transistors Tr1 and Tr2 become conductive and transistors Tr3 and Tr4 nonconductive. This causes a short-circuit between the two terminals of DC motor 11, and a braking current I flows in the direction indicated by a dotted line in FIG. 6 (2) to brake the DC motor 11.

Referring to FIG. 6 (3), when providing a negative-phase braking mode, CPU 30 places the output line a in high level and the output line b in low level. As a result, transistors Tr1 and Tr4 become conductive and transistors Tr2 and Tr3 nonconductive. The braking current I then flows as shown in a dotted line in FIG. 6 (3), to apply a voltage of reversed polarity to the DC motor 11 whereby a braking force acts on the DC motor 11.

Figure 7:
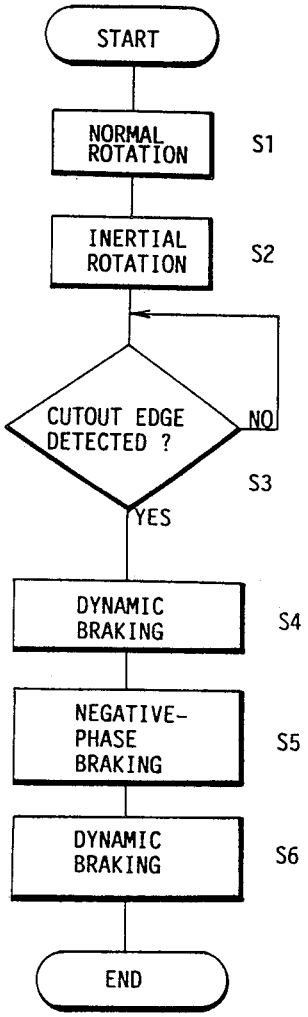
FIG. 7 is a flow chart showing a sequence of braking the DC motor at the time of moving the thermal head into pressure contact.
Figure 8:
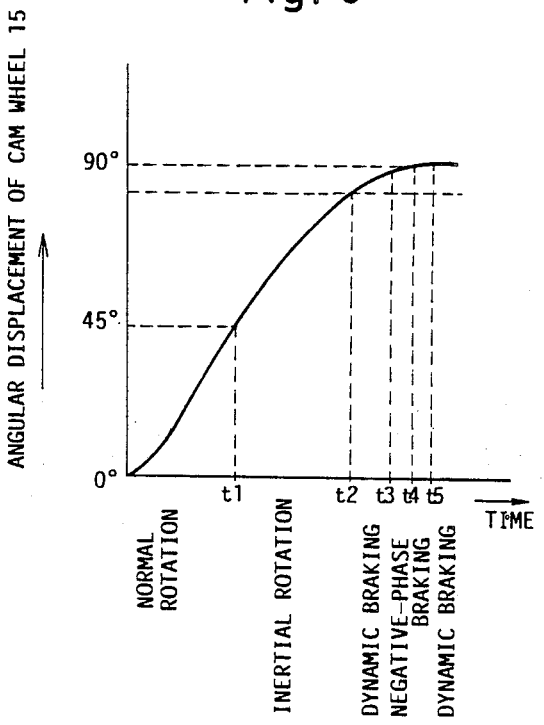
FIG. 8 is a graph showing an angular displacement of a cam wheel for moving the thermal head into pressure contact.

FIG. 7 is a flow chart showing a sequence of braking the DC motor when moving the thermal head 3*a* into pressure contact. First, CPU 30 places the output line a in low level and the output line b in high level, with the thermal head 3*a* separated from the platen roller 2 as shown in FIG. 3 (2). This results in the normal rotation mode at step S1, whereby the cam wheel 15 and detection wheel 16 are rotated in the direction of arrow P. The timer 32 comes into operation simultaneously with the start of cam wheel rotation in the normal rotation mode. When the timer 32 counts up to a predetermined point of time t1 while the cam wheel 15 is in rotation, CPU 30 places both of the output lines a and b in low level. The program thus moves to step S2 for the inertial rotation mode. At time t1 the cam wheel 15 is at a position of about a 45 degree angular displacement as illustrated in FIG. 8.

Although no voltage is applied to the DC motor 11 in the inertial rotation mode as described, the forces of inertia and of spring 9 keep the DC motor 11 rotating at gradually reducing speed.

At step S3, checks are made to determine whether the photosensor 26 has detected one of the edges 25a1 of the cutout 25a in the course of the inertial rotation mode. When the detection is made at a point of time t2, the program moves to step S4 where CPU 30 places the output line a in high level and the output line b in low level. Thus, the dynamic braking mode sets in at the time t2. As a result, the cam wheel 15 is rapidly decelerated from the point of time t2 onward as shown in FIG. 8.

The program moves to step S5 at a point of time t3, to place the output line a in high level and the output line b in low level for providing the negative-phase braking mode. In the negative-phase braking mode a voltage of reversed polarity is applied to the DC motor 11 as described, and therefore a greater breaking force than in the dynamic braking mode acts on the DC motor 11. As a result, the cam wheel 15 is further decelerated from the time t3 onward as shown in FIG. 8. the program moves from step S5 to step S6 at a point of time t4, to reinstate the dynamic braking mode by placing both of the output lines a and b in high level. At a point of time t5 during the dynamic braking mode the cam wheel 15 reaches and stops at the second stopping position. At this time the thermal head 3a is pressed on the platen roller 2 as shown in FIG. 3 (1). Dynamic braking is maintained after the DC motor 11 after the point of time t5 to lock the cam wheel 15 at the second stopping position. The dynamic braking alone would necessitate a relatively long braking distance. The present invention, however, employs the dynamic braking and negative-phase braking to reduce the braking distance and to shorten the braking time as well. By using both the dynamic braking and negative-phase braking, the cam wheel 15 is stopped precisely at the first stopping position to press the thermal head 3a on the platen roller 2 with a desired pressing force and assure clear prints at all times.

According to the present invention, the negative-phase braking is applied after the DC motor 11 is decelerated to a sufficiently low speed by the dynamic braking instead of using the negative-phase braking only. If the negative-phase braking were used alone, the motor portion 12 and gear head portion 13 could be damaged due to overstrain.

Figure 9:
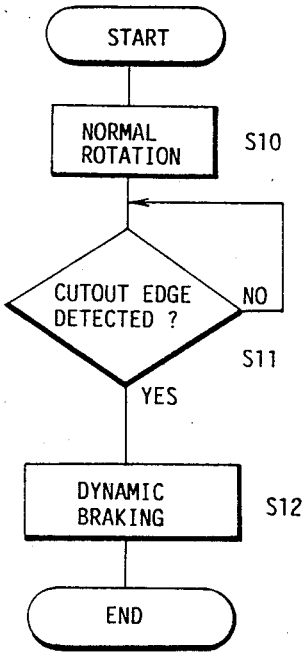
FIG. 9 is a flow chart showing a sequence of braking the DC motor at the time of moving the thermal head out of pressure contact.
Figure 10:
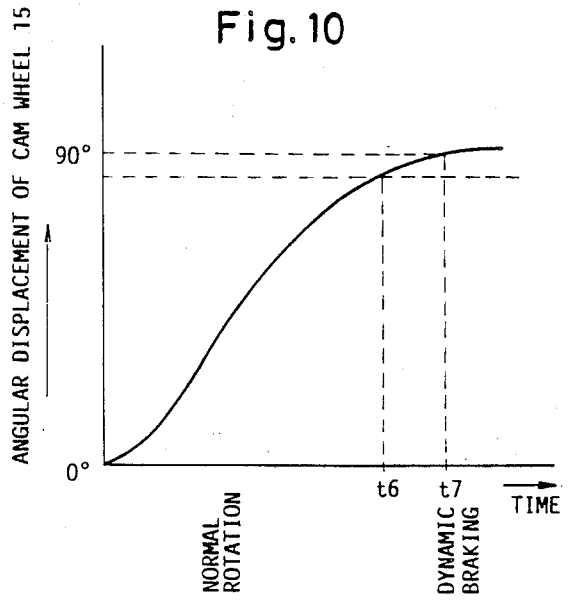
FIG. 10 is a graph showing an anglular displacement of the cam wheel for moving the thermal head out of pressure contact.

FIG. 9 is a flow chart showing a sequence of braking the DC motor at the time of moving the thermal head 3a out of pressure contact. First, step S10 provides the normal rotation mode by placing the output line a in low level and the output line b in high level, with the thermal head 3a in pressure contact with the platen roller 2 as shown in FIG. 3 (1). This causes the cam wheel 15 and detection wheel 16 to rotate in the direction of arrow P. At step S11, checks are made to determine whether the photosensor 26 has detected the other edge 25a2 of the cutout 25a. When the detection is made at a point of time t6, the program moves to step S4 to place both of the output lines a and b in high level and provide the dynamic braking mode. As a result, the cam wheel 15 is rapidly decelerated from the point of time t6 onward and stops at the second stopping position at a point of time t7 as shown in FIG. 10. At this time the thermal head 3a is positioned away from the platen roller 2 as shown in FIG. 3 (2). Dynamic braking is maintained after the point of time t7 to lock the cam wheel 15 at the second stopping position. In the thermal head separating operation, the dynamic braking results in a sufficiently short braking distance since the DC motor 11 is additionally braked by the friction between the cam wheel 15 and friction plate 17. Only the dynamic braking is used in this case since it will serve the purpose to move the thermal head 3a away from the platen roller 2. It is not necessary to stop the cam plate 15 with high precision, and so there is no need for using both the dynamic braking and negative braking as when moving the thermal head 3a into pressure contact. However, the dynamic braking and negative-phase braking may both be used in the head separating operation as well.

While the flow charts of FIGS. 7 and 9 have been described in relation to the cutout 25a, a similar operation is carried out in relation to the other cutout 25b.

In the foregoing embodiment, the thermal head 3a are alternately moved into and out of pressure contact with the rotation of cam wheel 15 through 90 degrees. The present invention is not limited to this feature, and the alternation may take place at every 180 or 45 degree rotation. In other words, the 360 degrees may be divided into a plurality of equal parts for effecting the alternating movements. The cam wheel 15 would be shaped to suit the selected dividing mode.

Further, in the foregoing embodiment, the DC motor 11 is rotatable in one direction to drive the thermal head 3a. Alternatively, a reversible motor may be used to perform this function.

Still further, the described embodiment includes the detection wheel 16 defining the cutouts 25a and 25b for detecting the cam wheel 15 at the first and second stopping positions. Instead of this construction, the cam wheel 15 itself may define such cutouts or otherwise include elements to be detected. Then the detection wheel 17 is dispensable. Also the photosensor 26 may be replaced with a magnetic sensor, an ultrasonic sensor or the like.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A thermal printer, comprising:

a thermal head adapted for movement into and out of pressure contact with a platen roller;

pressing and separating means for moving said thermal head between a contact position and a separated position;

a DC motor driving said pressing and separating means, said motor including feeder terminals for receiving an input voltage;

first braking means for causing a short-circuit between said feeder terminals;

second braking means for applying a braking voltage to said feeder terminals, said braking voltage having a polarity opposite that used to drive said motor; and control means for stopping said thermal head at said contact position during movement from said separated to said contact position by alternately activating said first braking means and said second braking means prior to said thermal head reaching said contact position and for stopping said thermal head at said separated position during movement from said contact to said separated position by activating only said first braking means prior to said thermal head reading said separated position

2. A thermal printer as in claim 1, further comprising detecting means for detecting the position of said pressing and separating means, and said control means activating said first and said second braking means in response to output from said detecting means.

* * * * *